US010557329B2

(12) United States Patent
Gao et al.

(10) Patent No.: US 10,557,329 B2
(45) Date of Patent: Feb. 11, 2020

(54) SYSTEMS AND METHODS FOR CONTROLLING FLUID FLOW IN A WELLBORE USING A SWITCHABLE DOWNHOLE CROSSOVER TOOL WITH ROTATABLE SLEEVE

(71) Applicant: HALLIBURTON ENERGY SERVICES, INC., Houston, TX (US)

(72) Inventors: Bo Gao, Spring, TX (US); Lonnie Carl Helms, Humble, TX (US); Aniruddha Gadre, The Woodlands, TX (US); Yuzhu Hu, Spring, TX (US); Gary Makowiecki, Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/308,338

(22) PCT Filed: Sep. 23, 2016

(86) PCT No.: PCT/US2016/053485
§ 371 (c)(1),
(2) Date: Dec. 7, 2018

(87) PCT Pub. No.: WO2018/057004
PCT Pub. Date: Mar. 29, 2018

(65) Prior Publication Data

US 2019/0257175 A1 Aug. 22, 2019

(51) Int. Cl.
*E21B 23/01* (2006.01)
*E21B 23/06* (2006.01)
(Continued)

(52) U.S. Cl.
CPC ..... *E21B 34/12* (2013.01); *E21B 23/01* (2013.01); *E21B 33/127* (2013.01); *E21B 33/13* (2013.01);
(Continued)

(58) Field of Classification Search
CPC ..... E21B 43/105; E21B 23/06; E21B 33/14; E21B 23/00; E21B 23/01; E21B 33/1291;
(Continued)

(56) References Cited

U.S. PATENT DOCUMENTS 4,565,213 A 1/1986 Giebeler
7,857,052 B2 12/2010 Giroux et al.
(Continued)

FOREIGN PATENT DOCUMENTS

WO 2015038119 A1 3/2015
WO 2015038171 A1 3/2015

OTHER PUBLICATIONS

International Search Report and Written Opinion dated Jun. 19, 2017 for international patent application No. PCT/US2016/053485, filed on Sep. 23, 2016.

*Primary Examiner* — Zakiya W Bates
(74) *Attorney, Agent, or Firm* — Chamberlain Hrdlicka

(57) ABSTRACT

A system, method, and tool for controlling fluid flow in a wellbore. The system comprises a tubing string locatable in the wellbore and a crossover tool for enabling reverse circulation in the wellbore. The crossover tool comprises a tool body, a packer assembly, a drag block assembly, and a sleeve. The tool body comprises a bore in fluid communication with the tubing string and a valve located in the bore. The packer assembly is coupled to the tool body and creates a fluid barrier in the annulus formed between the tubing string and the wellbore. The drag block assembly engages the wellbore and resists axial movement. The sleeve is
(Continued)

located in the tool body and axially moveable relative to the drag block assembly. The drag block assembly is coupled to the sleeve, and axial movement of the sleeve relative to the drag block assembly rotates the sleeve to control the valve.

18 Claims, 11 Drawing Sheets

(51) Int. Cl.

| | |
|---|---|
| ***E21B 34/12*** | (2006.01) |
| ***E21B 33/127*** | (2006.01) |
| ***E21B 33/13*** | (2006.01) |
| *E21B 21/10* | (2006.01) |
| *E21B 33/14* | (2006.01) |
| *E21B 34/06* | (2006.01) |
| *E21B 34/00* | (2006.01) |

(52) U.S. Cl.
CPC ..... *E21B 21/103* (2013.01); *E21B 33/14* (2013.01); *E21B 34/063* (2013.01); *E21B 2034/002* (2013.01); *E21B 2034/007* (2013.01)

(58) Field of Classification Search
CPC ..... E21B 41/00; E21B 43/103; E21B 21/10; E21B 33/1292
See application file for complete search history.

(56) References Cited

U.S. PATENT DOCUMENTS

| | | | |
|---|---|---|---|
| 8,695,709 | B2 | 4/2014 | Zimmerman et al. |
| 2005/0103495 | A1 | 5/2005 | Corbett |
| 2009/0050335 | A1 | 2/2009 | Mandrou |
| 2013/0032397 | A1 | 2/2013 | Dirksen |
| 2014/0305662 | A1 | 10/2014 | Giroux et al. |

SYSTEMS AND METHODS FOR CONTROLLING FLUID FLOW IN A WELLBORE USING A SWITCHABLE DOWNHOLE CROSSOVER TOOL WITH ROTATABLE SLEEVE

CONTEXT

This section is intended to provide relevant contextual information to facilitate a better understanding of the various aspects of the described embodiments. Accordingly, it should be understood that these statements are to be read in this light and not as admissions of prior art.

In oil field recovery operations, a casing, in the form of a steel pipe, or the like, is often placed in an oil and gas well to stabilize the well bore. In these installations, a cement sheath is formed in the annulus between the casing and the wall of the wellbore to support the casing, to prevent migration of fluids in the annulus, and to protect the casing from corrosive formation fluids.

Cementing of a casing string is often accomplished by pumping a cement slurry down the inside of a tubing or a casing, and then back up the annular space around the casing. In this way, a cement slurry may be introduced into the annular space of the casing (e.g. the annular space between the casing to be cemented and the open hole or outer casing to which the casing is to be cemented). This circulation direction is often referred to as a conventional circulation direction.

Though conventional circulation methods are the methods most commonly used for pumping cement compositions into well bores, these methods may be problematic in certain circumstances. For instance, a well bore may comprise one or more weak formations therein that may be unable to withstand the pressure commonly associated with conventional circulation cementing operations. The formation may breakdown under the hydrostatic pressure applied by the cement, thereby causing the cement to be lost into the subterranean formation. This may cause the undesirable loss of large amounts of cement into the subterranean formation. The loss of cement into the formation is undesirable, among other things, because of the expense associated with the cement lost into the formation. Likewise, high delivery pressures can cause the undesirable effect of inadvertently "floating" the casing string. That is, exposing the bottom hole of the well bore to high delivery pressures can, in some cases, cause the casing string to "float" upward. Moreover, the equivalent circulating density of the cement may be high, which may lead to problems, especially in formations with known weak or lost circulation zones.

Another method of cementing casing, sometimes referred to as reverse circulation cementing, involves introducing the cement slurry into the annular space rather than introducing the cement slurry down the casing string itself. In particular, reverse circulation cementing avoids the higher pressures necessary to lift the cement slurry up the annulus. Other disadvantages of having to pump the cement slurry all the way down the casing string and then up the annulus are that it requires a much longer duration of time than reverse circulation cementing. This increased job time is disadvantageous because of the additional costs associated with a longer duration cementing job. Moreover, the additional time required often necessitates a longer set delay time, which may require additional cement retarders or other chemicals to be added to the cement slurry.

A crossover tools enables reverse circulation from an internal flow path of a tool string into the annulus area to be cemented. With a crossover tool, the reverse circulation can be applied at any point along the wellbore, for example cementing a liner hanger and its liner in the wellbore. However, crossover tools cannot switch the flow path back to a conventional circulation direction.

DESCRIPTION OF THE DRAWINGS

For a detailed description of the embodiments, reference will now be made to the accompanying drawings in which.

DETAILED DESCRIPTION

The present disclosure provides a crossover tool for enabling reverse circulation in a well. The crossover tool is switchable between conventional circulation and reverse circulation as needed to accommodate different stages of a cementing operation, separating fluids in the well, or controlling fluid circulation in the well.

Figure 1:
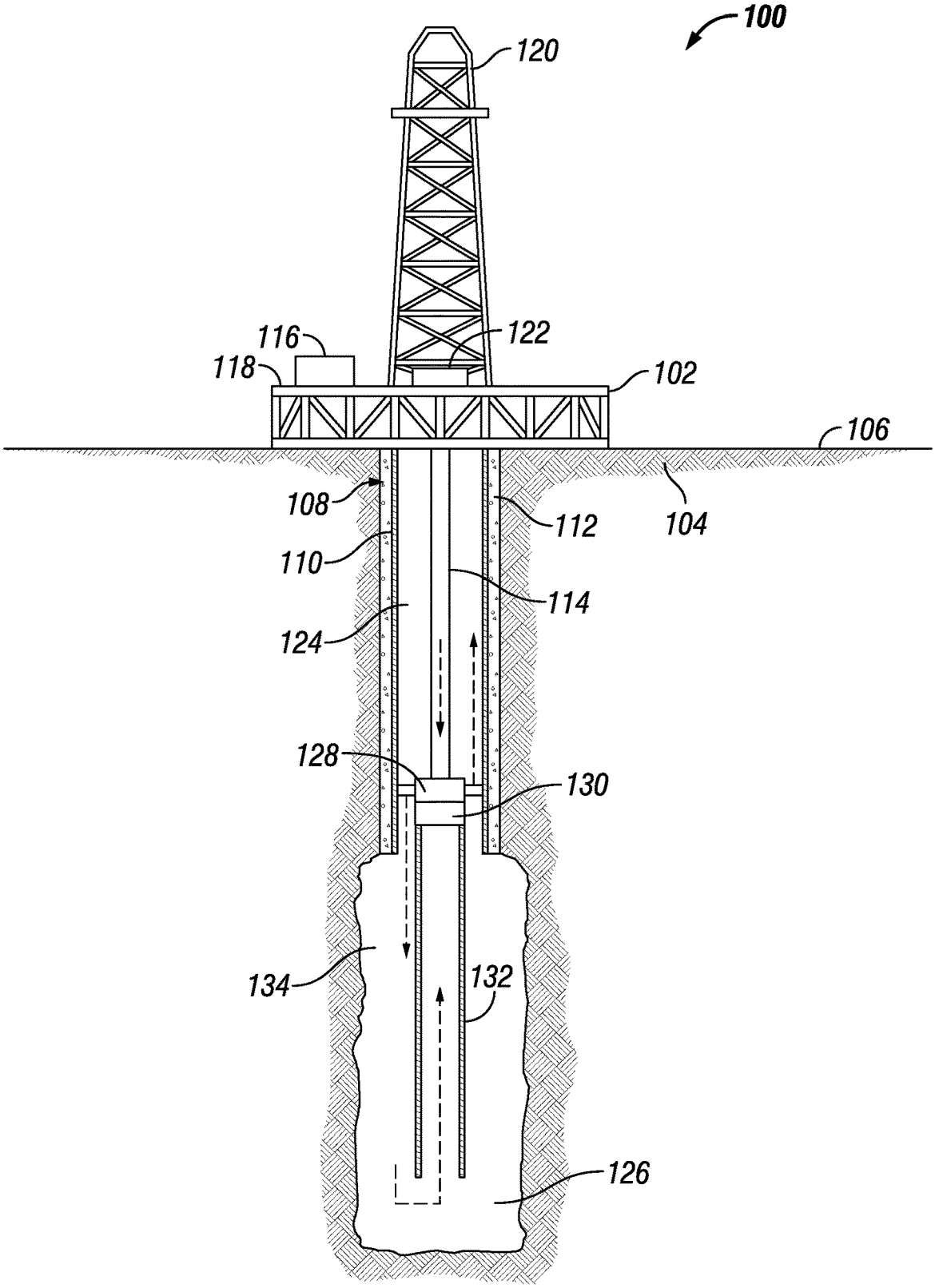
FIG. 1 shows an elevation view of a well system undergoing reverse circulation using a crossover tool, according to one or more embodiments.

FIG. 1 shows an elevation view of a well system 100 with a liner casing 132 undergoing reverse circulation using a crossover tool 128, in accordance with one or more embodiments. As shown, the system 100 includes a rig 102 centered over a subterranean oil or gas formation 104 located below the earth's surface 106. A wellbore 108 extends through the various earth strata including formation 104. The rig 102 includes a work deck 118 that supports a derrick 120. The derrick 120 supports a hoisting apparatus 122 for raising and lowering pipe strings such as a tubing string 114. A pump 116 may be located on the work deck 118 and is capable of pumping a variety of fluids, such as cementing material, into the well, through the tubing string 114. The pump 116 may include a pressure gauge that provides a reading of back pressure at the pump discharge. An upper casing string 110 is located in the wellbore 108 and held in place by cement 112. The upper casing string 110 defines an upper annulus 124, which provides a return flow path for the cementing material as further described herein.

A liner 132 is suspended within the wellbore 108 by the tubing string 114 and extends further downhole from the upper casing string 110. The liner 132 is coupled to a liner hanger 130, which connects the liner 132 to the tubing string 114. Above the liner hanger 130 and coupled to the tubing string 114 is the crossover tool 128 to control the circulation of fluids downhole. The crossover tool 128 is configured to control the circulation of fluid in the wellbore 108. Specifically, the crossover tool 128 is switchable between enabling reverse circulation and enabling conventional circulation flow through the wellbore 108.

As shown, during a reverse cementing operation for cementing liner 132, a cementing material is pumped, via the pump 116 located at the surface 106, into the pipe 114. The cementing material travels downhole through the tubing string 114 into the crossover tool 128. The cementing material is then directed out of the crossover tool 128 and continues downhole into a lower annulus 134 between the liner 132 and the wellbore 108 towards well bottom 126, thereby cementing the annulus 134. The fluid return path is uphole through the inside of the liner 132 into the crossover tool 128. The crossover tool 128 diverts the uphole flow into the upper annulus 124 to the surface 106. The upper annulus 124 is separated from the lower annulus 134 by the crossover tool 128. Thus, the crossover tool 128 can isolate a reverse circulation flow path downhole to cement the liner 132 and return the cementing material uphole in a conventional flow path through the annulus 124.

The wellbore 108 may be filled with various fluids such as drilling fluid which may be displaced uphole through the upper annulus 124. Drilling fluid has a different density profile than cementing material. For example, the drilling fluid can have a lower density than cementing material. Drilling fluid may be any type of drilling fluid such as a water-based or oil-based drilling fluid. The cementing material used may be any suitable resin or hydraulic cementitious material including, for example only, those comprising calcium, aluminum, silicon, oxygen and/or sulfur which set and harden by reaction with water. Such hydraulic materials may include Portland cements, pozzolana cements, gypsum cements, high aluminum content cements, silica cements and high alkalinity cements.

The crossover tool 128 may also be used to separate fluids in the wellbore 108. For example, the crossover tool 128 may be used to replace the fluid in the lower annulus 134 with a different fluid, such as a different drilling fluid, completion fluid, or treatment fluid.

Figure 2:
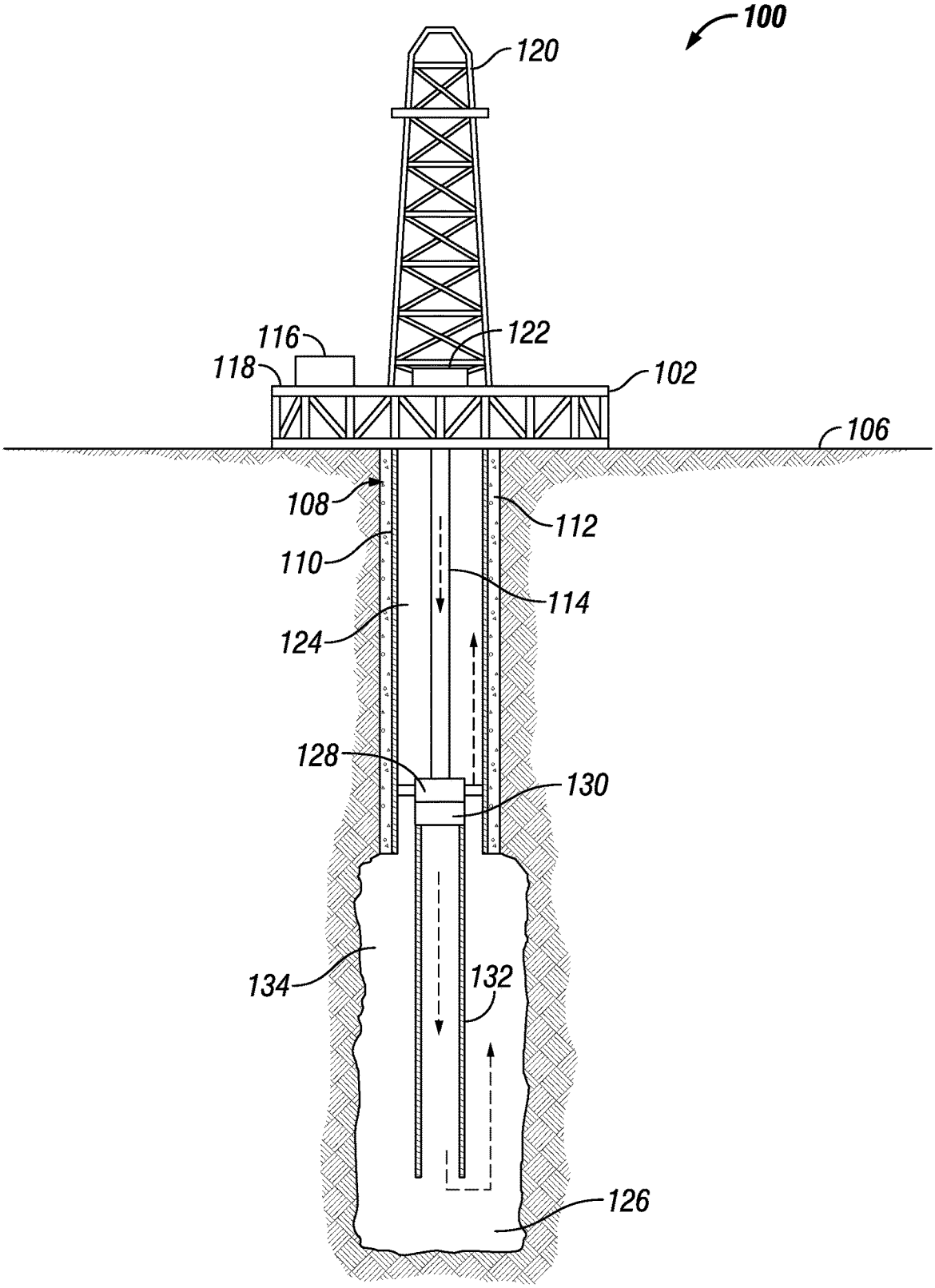
FIG. 2 shows an elevation view of the well system undergoing conventional circulation using the crossover tool, according to one or more embodiments.

FIG. 2 shows a schematic view of the well system 100 operating in a conventional circulation mode as directed by the crossover tool 128, in accordance with one or more embodiments. As shown, downhole flow is delivered through the tubing string 114 and through the inside of the liner 132 towards well bottom 126. The flow path is directed uphole through the lower annulus 134 between the liner 132 and the wellbore 108. The flow path is diverted through the crossover tool 128 into the upper annulus 124 to the surface 106 as further described herein. The crossover tool 128 can be switched back and forth between the conventional circulation mode and the reverse circulation mode multiple times. It should be appreciated that the crossover tool 128 may deliver fluid downhole under a reverse or conventional circulation flow path with any suitable fluid and is not limited to controlling the circulation of cementing material. The flow paths of the crossover tool 218 and other aspects of the crossover tool are described in further detail herein with respect to FIGS. 3-21.

Figure 3:
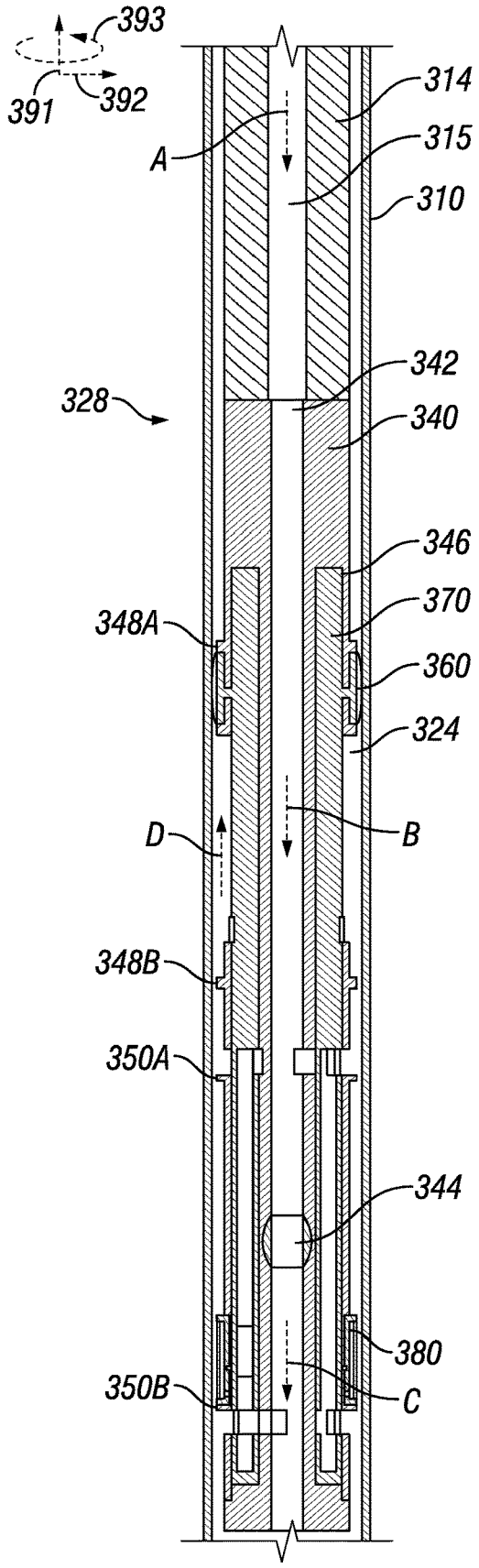
FIG. 3 shows a cross-section view of a crossover tool in a conventional circulation mode, according to one or more embodiments.

FIG. 3 shows a cross-section view of a crossover tool 328 coupled to a tubing string 314 used in a casing string 310, according to one or more embodiments. As shown, the crossover tool 328 is suspended in the casing string 310 by the tubing string 314 and configured to allow fluid to flow in a conventional circulation path. That is, fluid flows from the tubing string 314 through a crossover tool bore 342, down to the well bottom (e.g., the well bottom 126 of FIG. 1), and returns to the surface via an annulus 324 as indicated by arrows A-D. It should be appreciated that the casing string 310 is exemplary and the crossover tool 328 may deployed in any suitable tubular, tubular string, wellbore, or the like.

The crossover tool 328 includes a tool body 340, a drag block assembly 360, a sleeve 370, and a packer assembly 380. A bore 342 runs through the tool body 340 and is in fluid communication with a tubing string bore 315 to provide a flow path through the crossover tool 328. A valve 344 intersects the bore 342 to control the flow of fluid through the crossover tool 328. As shown, the valve 344 is open allowing fluid to flow through the crossover tool 328.

The sleeve 350 is housed in an annular cavity 346 in the tool body 340 and can rotate relative to the tool body 340 based on the drag block's 360 position with respect to collars 348A, 348B. Additionally, with the valve 344 coupled to the sleeve 370 through the tool body 340, the valve 344 can be actuated by the rotational movement of the sleeve 370 relative to the tool body 340. As shown, the collars 348A, 348B are separated along the longitudinal axis of the tool body 340 and in part define the range of rotational movement transferred to the sleeve 370 from the axial displacement of the drag block assembly 360.

The drag block assembly 360 is coupled to the sleeve 370 through the tool body 340 and positioned between collars 348A, 348B. As the crossover tool 328 is run into the casing string 310 in a downward direction, the drag block assembly 360 maintains engagement with the collar 348A by engaging the casing string 310 with spring-loaded buttons as further described herein. With the drag block assembly 360 engaged with the collar 348A, the valve 344 remains in the open position as further described herein.

The packer assembly 380 is coupled to the tool body 340 between collars 350A, 350B. To set the packer assembly 380, fluid in the crossover tool 328 can be diverted to expand or inflate the packer assembly 380, creating a fluid barrier in the annulus 324, and thus, forming an upper annulus and a lower annulus as described further herein. As shown, the packer assembly 380 is not set and allows fluid to flow through the annulus 324 in a conventional circulation path.

In one or more embodiments, the packer assembly 380 can be kept in this unset mode while the crossover tool 328 is being deployed to a wellbore position where reverse cementing is need to set a liner in the well.

In the following discussion, reference may be made to various directions or axes, such as a y-axis or direction 391, an x-axis or direction 392, and rotational direction 393 about the y-axis 391, as represented schematically on FIGS. 3, 10-13, and 20. It should be appreciated that these axes are in relation to the orientation of the crossover tool 328 and not set axes.

Figure 4:
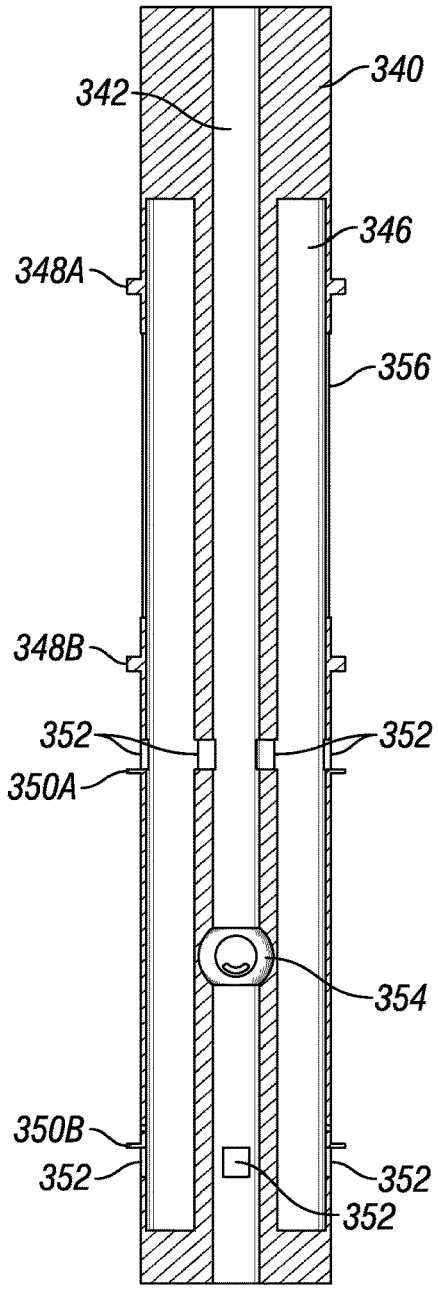
FIG. 4 shows a cross-section view of a tool body employed in the crossover tool of FIG. 3, according to one or more embodiments.

FIG. 4 shows a cross-section view of the tool body 340, according to one or more embodiments. As shown, the tool body 340 includes the annular chamber 346 where the sleeve 370 can rotate. Additionally, the tool body 340 includes ports 352 that provide fluid communication paths for reverse circulation or conventional circulation as further described herein. A cavity 354 is formed in the tool body 340 to hold the valve 344 (FIG. 3), allowing the valve 344 to rotate and control the flow of fluid through the crossover tool 328 as further described herein.

Figure 5A:
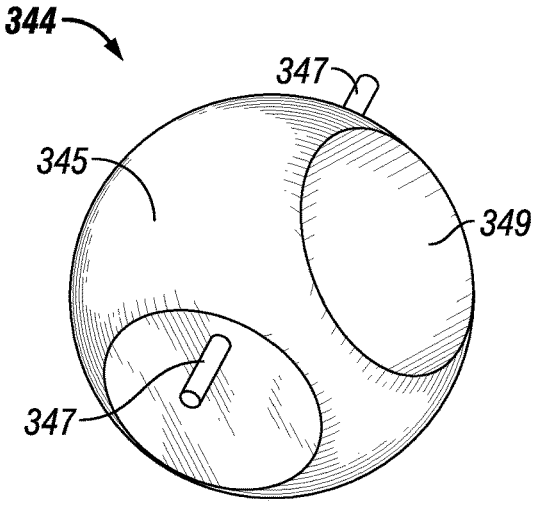
FIG. 5A shows an axonometric view of a valve employed in the crossover tool of FIG. 3, according to one or more embodiments.

FIG. 5A shows an axonometric view of the valve 344, in accordance with one or more embodiments. As shown, the valve 344 includes a ball valve 345 with two pins 347 extending radially outward. The ball valve 345 includes a bore 349 to control the flow of fluid through the valve 344. The pins 347 are received in the sleeve 370 such that the rotational movement of the sleeve 370 actuates the valve 344 to either a closed position or an open position.

Figure 5B:
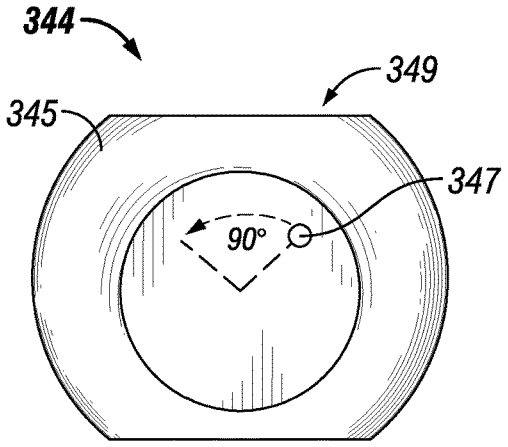
FIG. 5B shows a cross-section view of the valve of FIG. 5B, according to one or more embodiments.

FIG. 5B shows a cross-section view of the valve 344, in accordance with one or more embodiments. As shown, the ball valve 344 can be rotated on the pins 347 by a quarter-turn (e.g., 90°) to switch from the open position to the closed position or vice-versa. In one or more embodiments, the valve 344 can include any suitable device to regulate the flow of fluid through the crossover tool based on the axial movement of the sleeve 370. For example, the valve 344 may include a gate valve rather than a ball valve.

Figure 6:
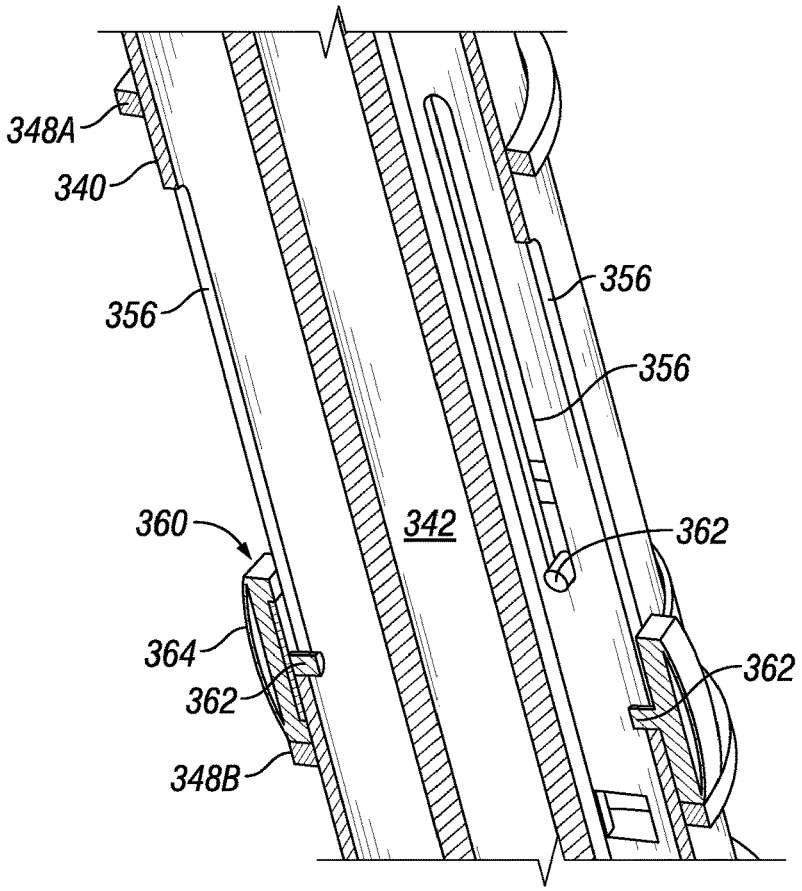
FIG. 6 shows a cross-section view of the tool body with a drag block assembly attached, according to one or more embodiments.

FIG. 6 shows a cross-section view of the tool body 340 with the drag block assembly 360 attached, according to one or more embodiments. As shown, pins 362 on the drag block assembly 360 extend radially inward through slots 356 on the tool body 340. These slots 356 allow the tool body 340 to move axially relative to the drag bock assembly 360 as the drag block assembly engages the casing string 310 (FIG. 3).

Figure 7:
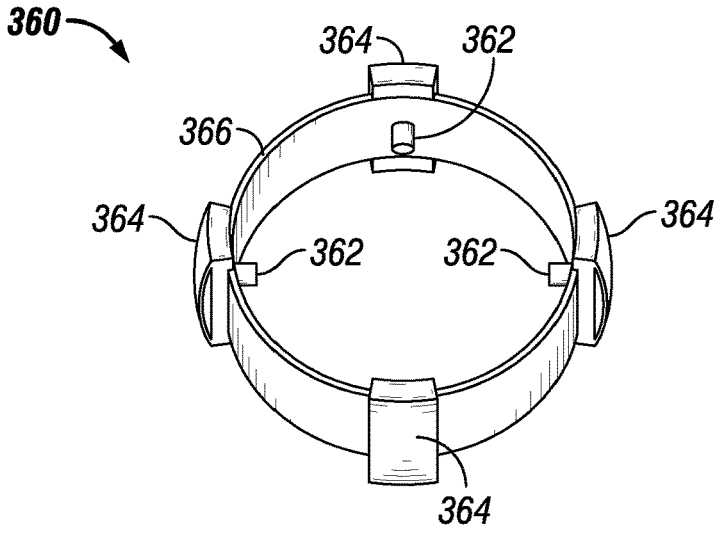
FIG. 7 shows an axonometric view of the drag block assembly of FIG. 3, according to one or more embodiments.

FIG. 7 shows an axonometric view of the drag block assembly 360, according to one or more embodiments. As shown, the drag block assembly 360 may include spring-loaded buttons 364 (e.g., carbide buttons) azimuthally separated on an annular body 366. The drag block assembly 360 may include a mechanism with springs that apply an outward radial force to enable the buttons 362 to drag along the inner diameter of the casing string 310 (FIG. 3) and exert an axial force that allows the sleeve 370 of the crossover tool 328 to be manipulated in a rotational direction. The drag block assembly 360 engages the casing string 310 (FIG. 3) to create friction and resist axial movement as the tool body 340 is lowered or raised in the wellbore. Positioned inside the annular body 366 are the pins 362, which are received in the sleeve 370 to transfer axial movement of the sleeve 370 into rotational movement of the sleeve 370 as further described herein.

Figure 8:
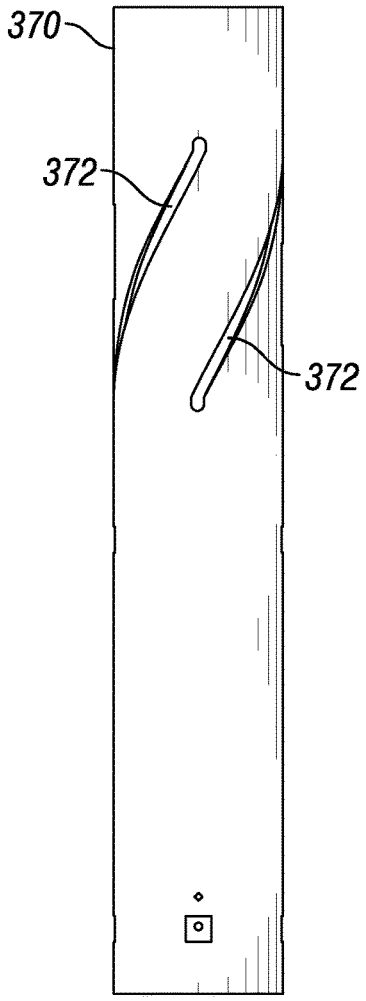
FIG. 8 shows an axonometric view of a sleeve employed in the crossover tool of FIG. 3, according to one or more embodiments.

FIG. 8 shows an axonometric view of the sleeve 370, according to one or more embodiments. As shown, helical grooves 372 are formed on the sleeve 370 to receive the pins 362 on the drag block assembly 360 such that the axial movement of the sleeve 370 relative to the drag block assembly 360 rotates the sleeve 370 relative to the drag block assembly 360. That is, the helical grooves 372 and the drag block assembly 360 operate as a cam mechanism to apply a rotational movement to the sleeve 370 from the axial movement of the sleeve 370 relative to the drag block assembly 360.

Figure 9:
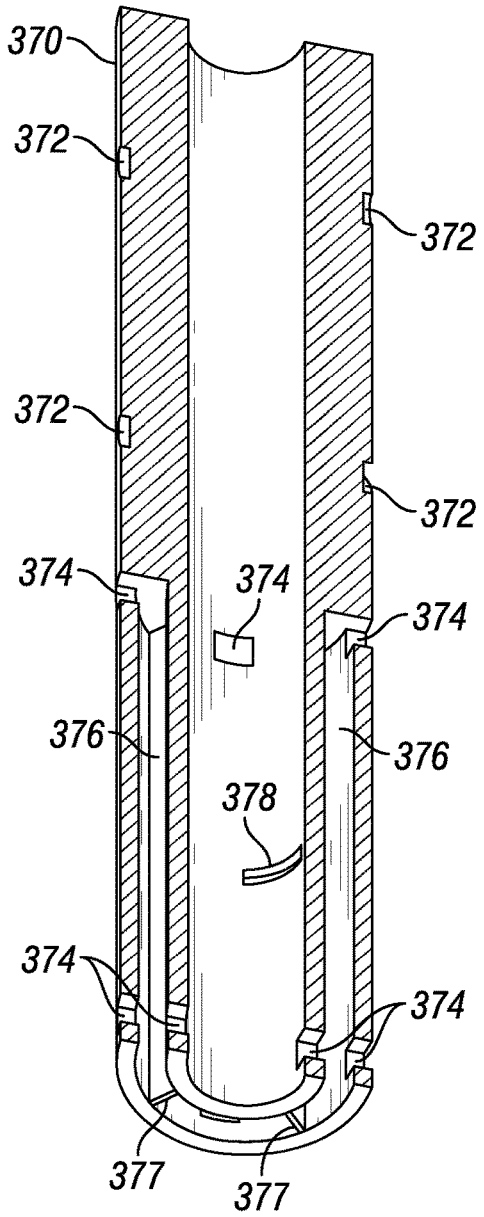
FIGS. 9 and 10 shows cross-section views of the sleeve of FIG. 7, according to one or more embodiments.
Figure 10:
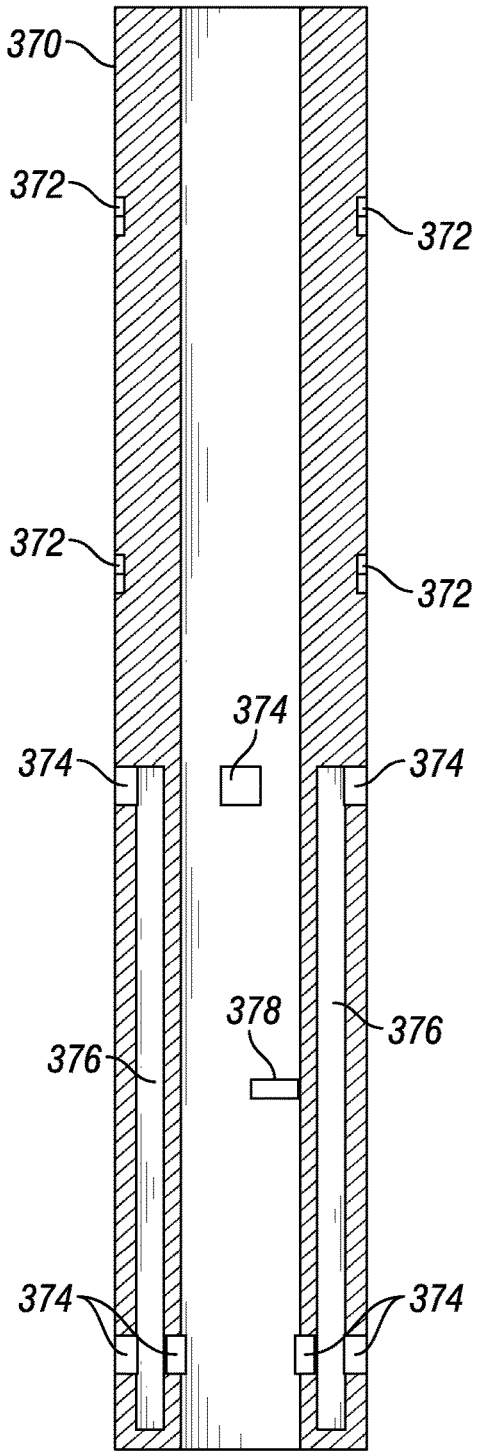

FIGS. 9 and 10 show cross-section views of the sleeve 370, according to one or more embodiments. As shown, the sleeve 370 is a tubular device with ports 374 and channels 376 to direct the flow of fluid through the crossover tool 328. The channels 376 are divided by walls 377 defining two channels 376 for delivering fluid in a first direction and two channels 376 for delivering fluid in a second direction opposite to the first. It should be understood that the sleeve 370 can include any suitable number of channels 376 to direct the flow of fluid through the crossover tool 328. The sleeve 370 also includes a slot 378 to receive one of the pins 347 on the valve 344 (not shown) to actuate the valve 344 as the sleeve 370 rotates relative to the tool body 340.

Figure 11:
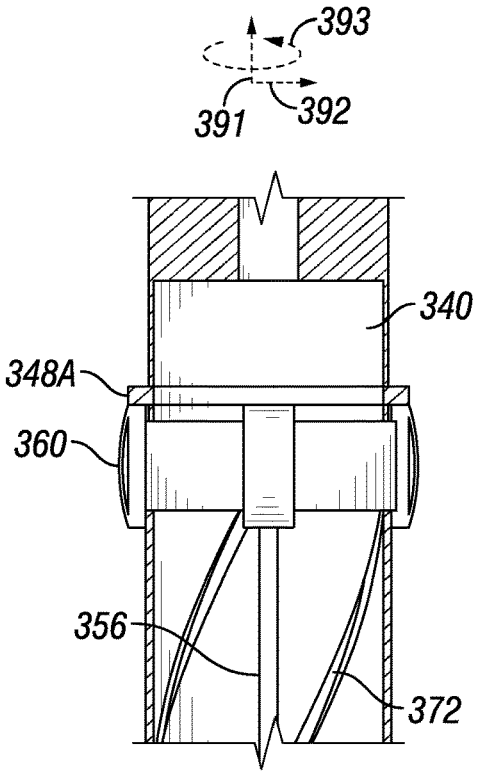
FIGS. 11-13 show axonometric views of the sleeve rotated relative to the tool body, according to one or more embodiments.
Figure 12:
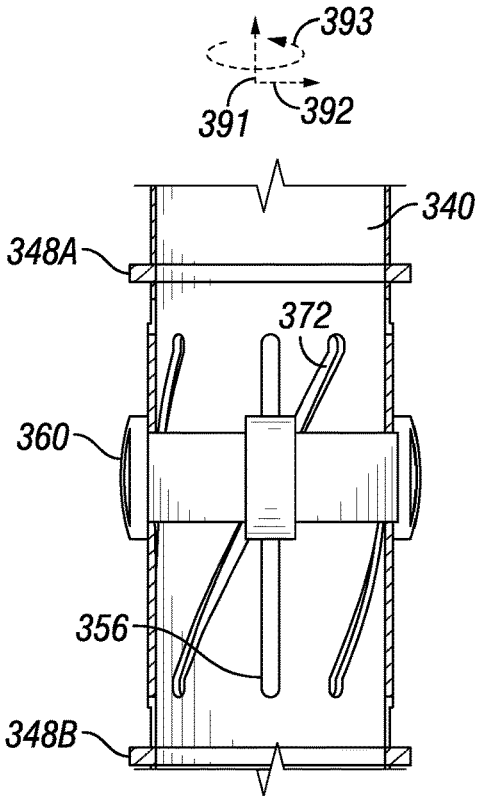
Figure 13:
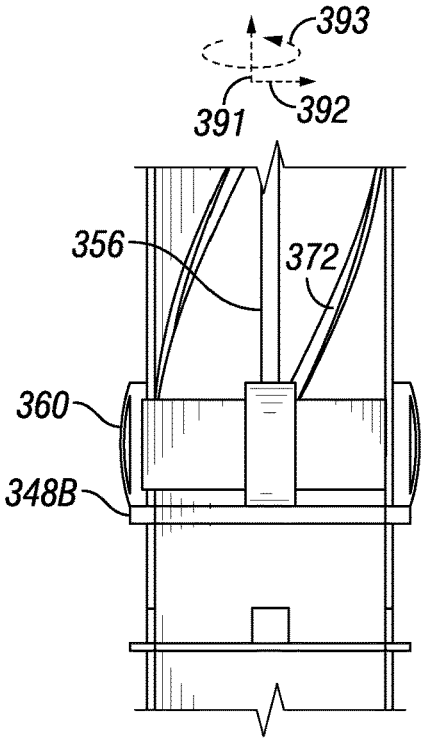

FIGS. 11-13 show axonometric views of the sleeve 370 rotated relative to the tool body 340 as directed by the drag block assembly 360 to actuate the valve 342, in accordance with one or more embodiments. As shown in FIG. 11, the drag block assembly 360 is engaged with the collar 348A and coupled to the sleeve 370 in the helical grooves 372 through the slots 356 on the tool body 340. The sleeve 370 is in a first azimuthal orientation where the sleeve 370 keeps the valve 344 open to allow fluid flow through the crossover tool 328 in a conventional circulation path.

As shown in FIG. 12, as the tool body 340 is raised or lowered in the wellbore, the sleeve 370 moves in an axial direction (e.g., along the y-axis 391), while the drag block assembly 360 resists axial movement by engaging the casing string 310 (FIG. 3). As the sleeve 370 moves in an axial direction (e.g., along the y-axis 391), the pins 362 on the drag block assembly 360 engage the helical grooves 372 to rotate (e.g., in the rotational direction 393) the sleeve 370. As the sleeve 370 rotates, the slot 378 (FIG. 9) engages one of the pins 347 (FIG. 5A) on the valve 344 to rotate the valve 344 in the bore 342 to a partially opened position. Thus, as illustrated in FIG. 11, the sleeve 370 is in an azimuthal orientation where the valve 344 is partially open.

As illustrated in FIG. 13, the tool body 340 and sleeve 370 continue to move in the axial direction such that the drag block assembly 380 engages the collar 348B. The sleeve 370 rotates to a second azimuthal orientation that closes the valve 344 and diverts the fluid in the crossover tool 328 as further described herein.

Figure 14:
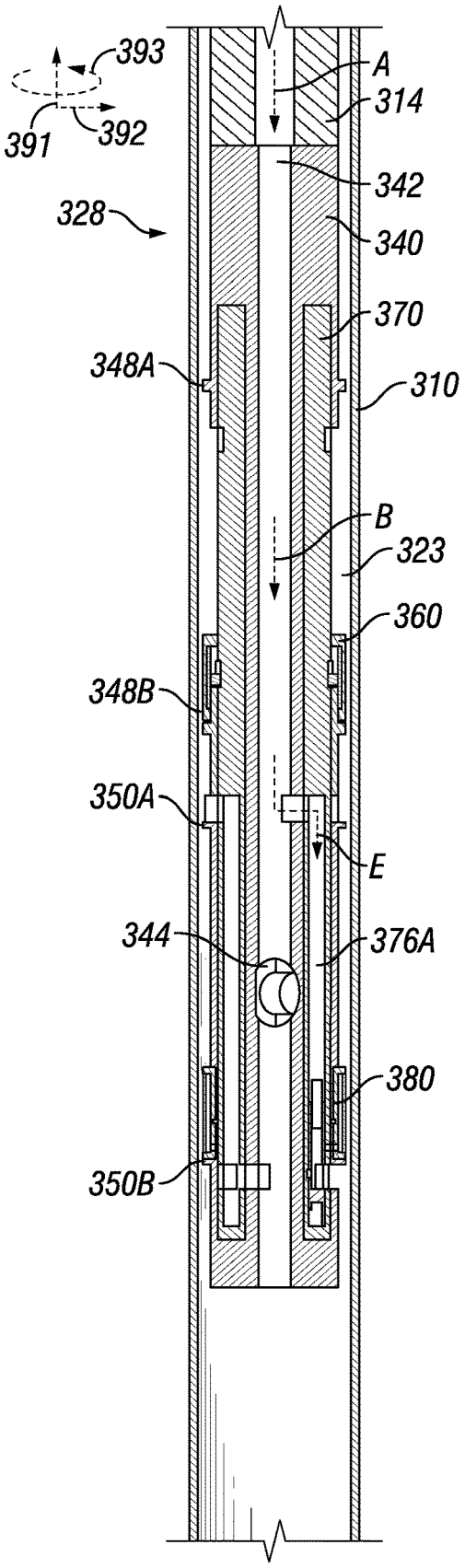
FIG. 14 shows a cross-section view of the crossover tool diverting fluid to set the packer assembly of FIG. 3, according to one or more embodiments.

FIG. 14 shows a cross-section view of the crossover tool 328 with the valve 344 in a closed position diverting fluid, in accordance with one or more embodiments. As shown, with the valve 344 in the closed position the fluid is diverted into a reverse flow channel 376A of the sleeve to expand the packer assembly 380, which in turn creates a fluid barrier in the annulus 324 as further described herein. The diverted flow path of the fluid is indicated by arrows A, B, and E.

The valve 344 can be actuated into the open or closed position depending on the direction of rotational movement applied to the sleeve 370. For example, if the sleeve 370 is rotated in a first rotational direction (e.g., in the rotational direction 393), the valve 344 is actuated to a closed position, while if the sleeve 370 is rotated in a second rotational direction (e.g., in the opposite rotational direction than the direction 393), the valve 344 is actuated to an open position. It should be appreciated that with the drag block assembly 360 engaged with the casing string 310, the direction of axial movement applied to the tool body 340 and in turn the sleeve 370 controls the rotational direction transferred to the sleeve 370 to actuate the valve 344 in a closed or open position.

Figure 15:
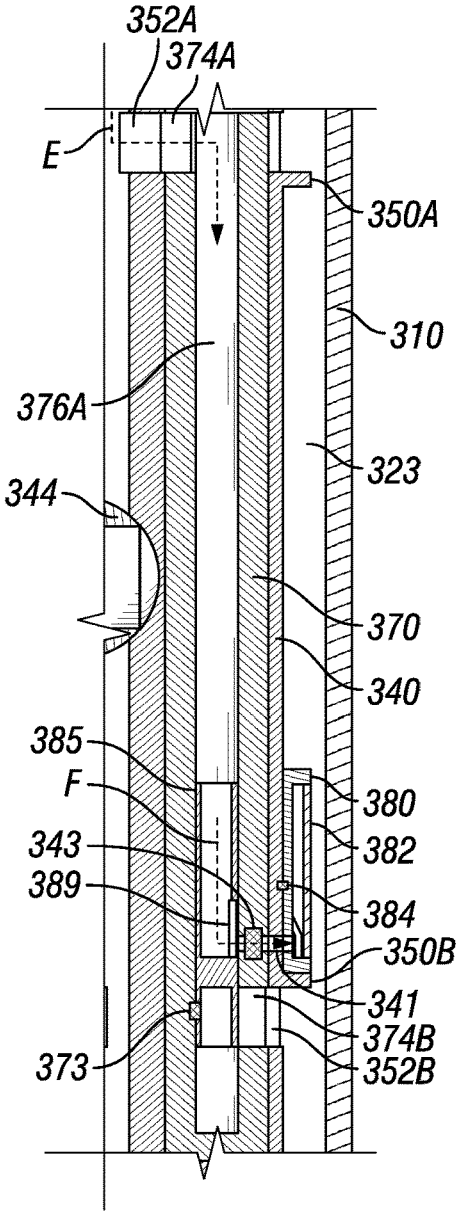
FIGS. 15-17 show cross-section views of the crossover tool of FIG. 3 diverting fluid to set the packer assembly and deliver fluid in a reverse circulation path, according to one or more embodiments.
Figure 16:
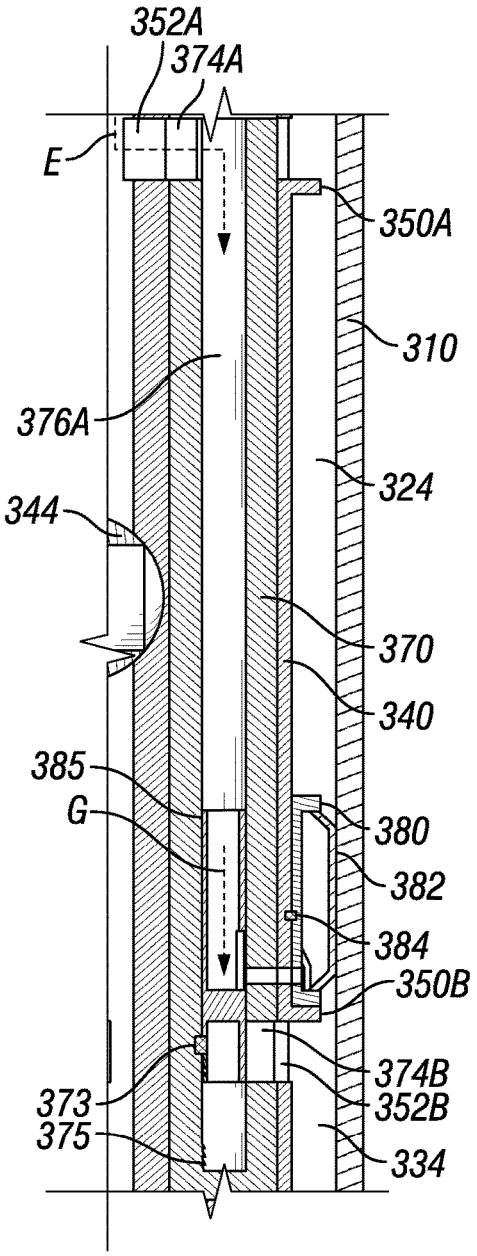
Figure 17:
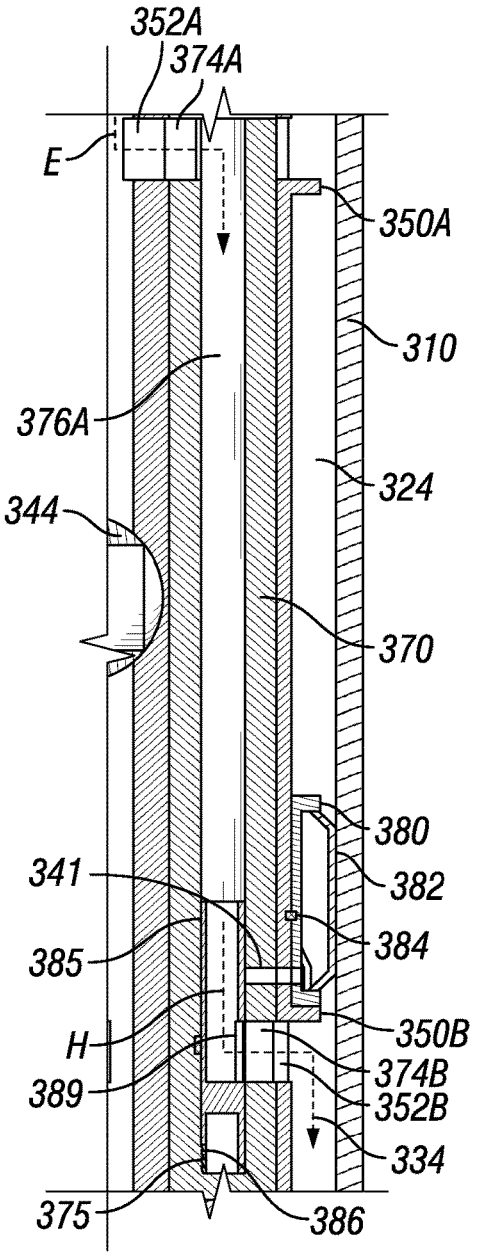

FIGS. 15-17 shows cross-section views of the crossover tool 328 diverting fluid to set the packer assembly 380 and deliver the fluid in a reverse circulation path, in accordance with one or more embodiments. As shown in FIG. 15, with the valve 344 closed, pressure increases in the tool bore 342 and diverts fluid into the channel 376A through ports 352A, 374A as indicated by arrow E. A piston 385 resides in the channel 376A and can operate as a pressure-controlled valve. For example, the position of the piston 385 in the channel 376A controls if fluid flows into either the packer assembly 380 or the annulus 324. It should be appreciated that a similar piston can reside in other channels included on the crossover tool 328 and used to divert fluid into a lower annulus.

In FIG. 15, the piston 385 is positioned in the channel 376A to divert the fluid through a port 389 to the packer assembly 380 and expand or inflate a bladder 382 on the packer assembly 380 as indicated by arrow F. The fluid is into a port 341 in fluid communication with the packer assembly 380 through the sleeve 370 and tool body 340. Additionally, or optionally, a rupture disk 343 may be positioned inside the port 341 to communicate fluid to the packer assembly 380 once a threshold pressure is reached in the channel 376A. For example, the rupture disk 343 can be included to prevent premature expansion of the packer assembly 380 while the crossover tool 328 is being run into the casing string 310. In one or more embodiments, the packer assembly 380 can be releasably coupled to the tool body 340 by a shear pin 384 to maintain alignment and fluid communication between the port 341 and the packer assembly 380.

As shown in FIG. 16, the bladder 382 is expanded radially outward relative to the tool body 340 and engages the casing string 310. With the bladder 382 expanded, the packer assembly 380 creates a fluid barrier in the casing string 310 to resist fluid communication between the upper annuls 324 and lower annulus 334.

With the packer assembly 380 set, the crossover tool 328 can control the circulation of fluid in the wellbore. As fluid continues to be delivered from the tubing string 314 (FIG. 3) as indicated by arrows E and G, pressure begins to build in the channel 376A, which can move the piston 385 to begin reverse circulation. Additionally, or optionally, a shear pin 373 is coupled to the piston 385 and channel 376A to allow the piston 385 to move once a threshold pressure is reached in the channel 376A.

In FIG. 17, the pressure in the channel 376A reached the threshold pressure to disable or shear the shear pin 373 attached to the piston, causing the piston 385 to move downward (e.g., along the y-axis 391) and allow fluid to flow through ports 352B, 374B into the lower annulus 334 as indicated by arrows E and H. Additionally, or optionally, the piston 385 serves as a fluid barrier between the channel 376A and the packer assembly 380, such as resisting fluid communication through the port 341, thus, sealing the packer assembly 380 and preventing the packer assembly 380 from deflating or contracting. This ensures the packer assembly 380 remains engaged with the casing string 310 to allow the crossover tool 328 to control the fluid circulation in the wellbore. In one or more embodiments, the piston 385 can include saw teeth 386 that engage with other saw teeth 375 in the channel 376A to secure the piston 385 in place. Additionally, or optionally, the piston 385 can include any suitable fastening device to secure the piston 385 in place in the channel 376A once the piston 385 is axially displaced as shown in FIG. 17.

Figure 18:
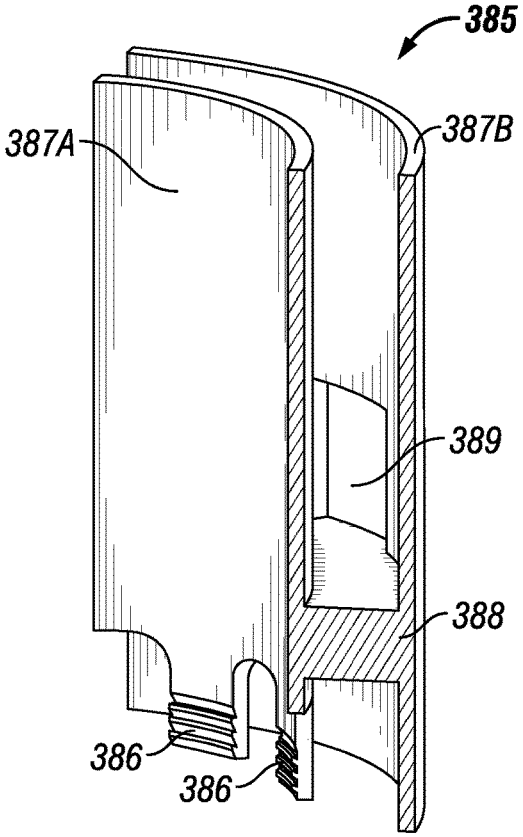
FIG. 18 shows an axonometric view of a piston used to divert fluid in a sleeve channel, according to one or more embodiments.

FIG. 18 shows an axonometric view of the piston 385 used to divert fluid in a sleeve channel (e.g., the channel 376A), in accordance with one or more embodiments. The piston 385 includes an interior wall 387A and an exterior wall 387B joined by an internal wall 388 to catch and direct fluid as the fluid flows through a sleeve channel (e.g., the channel 376A) used to divert fluid into a lower annulus (e.g., the lower annulus 334). On the exterior wall 377B, a port 389 is positioned to direct fluid flow through the piston 385, for example into either the packer assembly 380 or the lower annulus 334. It should be appreciated that the port 379 can be in fluid communication with either the packer assembly 380 or the lower annulus 334 depending on the piston's 385 position in a channel (e.g., the channel 376A). The saw teeth 386 or any other suitable fastening device can be included to secure the piston in place inside the crossover tool 328 once the piston 385 is axially displaced. It should be appreciated that the crossover tool 328 can include any number of suitable pistons depending on the number of channels used to divert fluid into a lower annulus.

Figure 19:
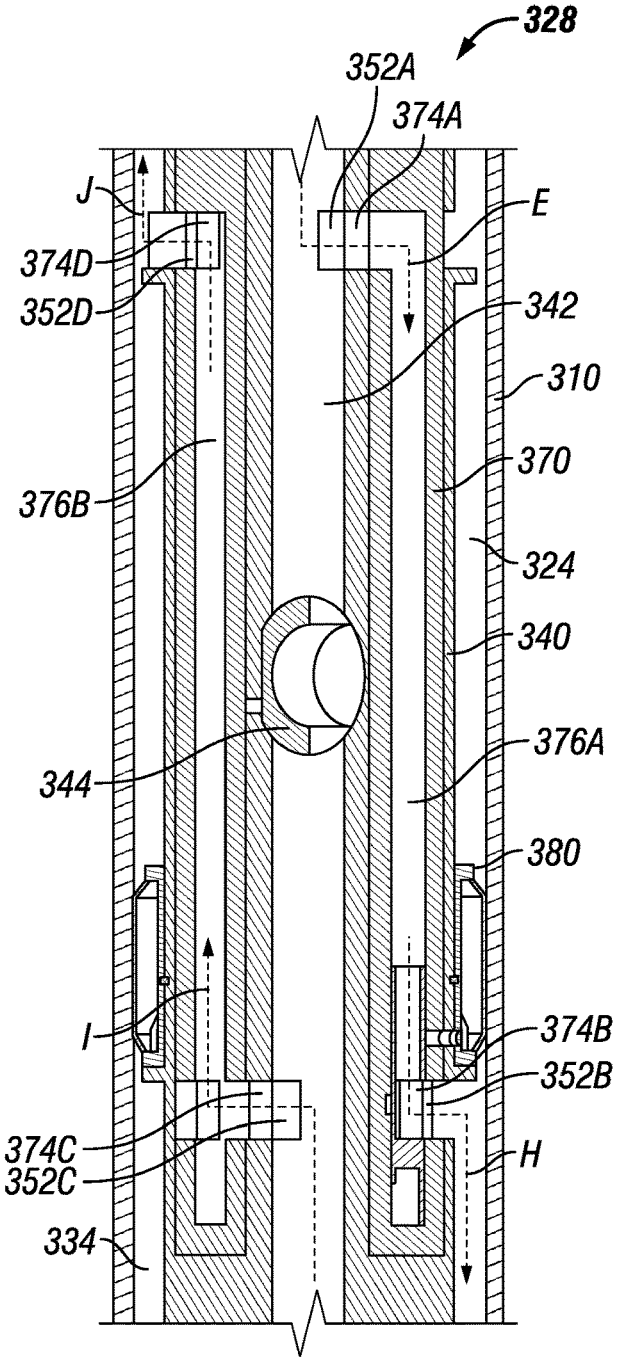
FIG. 19 shows a cross-section view of the crossover tool of FIG. 3 operating in a reverse circulation mode, according to one or more embodiments.

FIG. 19 shows an enlarged, cross-section view of the crossover tool 328 directing fluid in a reverse circulation flow path, in accordance with one or more embodiments. As shown, the fluid flows through the crossover tool bore 342 and is diverted (as indicated by arrow E) by the valve 344 set in a closed position by the azimuthal orientation of the sleeve 370. With the packer assembly 380 set and the piston 385 positioned to be in fluid communication with the ports 352B, 374B, the fluid flows through the channel into the lower annulus as indicated by arrow H. As the fluid reaches the bottom of the well (e.g., the well bottom 126 of FIG. 1), the fluid returns to the crossover tool 328 through the liner bore (not shown). The fluid flowing through the crossover tool bore 342 is diverted (as indicated by arrow I) by the valve 344 into an upstream channel 376B in the sleeve through ports 352C, 374C. The fluid flows through the upstream channel 376B into the upper annulus 324 through ports 352D, 374C (as indicated by arrow J) to be delivered to the surface in a conventional circulation flow path. Thus, the packer assembly 380 isolates the reverse circulation flow path produced in the lower annulus 334 from the conventional circulation flow path produced in the upper annulus 324. It should be appreciated that FIGS. 14-17, and 19 are cross-section views and that the crossover tool 328 can include any suitable number of channels to produce the reverse circulation flow path in the lower annulus 334 and the conventional circulation flow path in the upper annulus 324.

Figure 20:
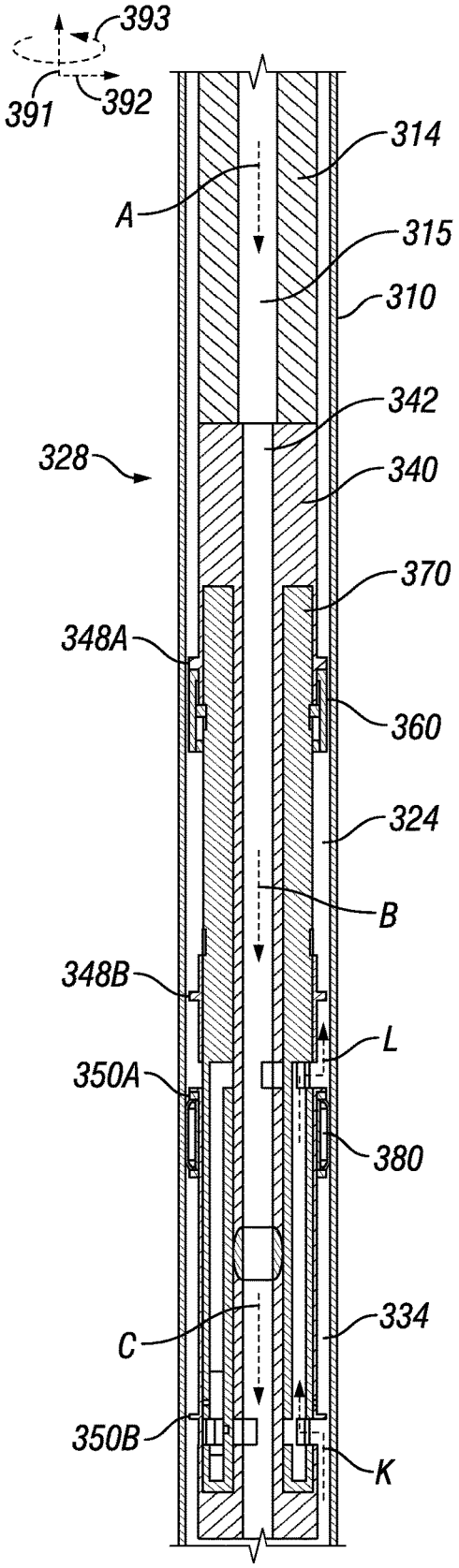
FIGS. 20 and 21 show cross-section views of the crossover tool of FIG. 3 operating in a conventional circulation mode with the packer assembly set, according to one or more embodiments.

FIG. 20 shows a cross-section view of the crossover tool 328 operating in a conventional circulation mode after switching from a reverse circulation mode as illustrated in FIG. 19, in accordance with one or more embodiments. As shown, with the packer assembly 380 set, the crossover tool 328 provides an alternative flow path to bypass the packer assembly 328 and deliver fluid in a conventional circulation flow path. The crossover tool 328 is moved in a second axial direction (e.g., in a downward vertical direction relative to the y-axis 391) to rotate the sleeve 370 (e.g., in the rotational direction opposite the direction 393) and open the valve 344. The drag block assembly 360 engages the collar 348A to return the sleeve 370 in the azimuthal orientation that sets the valve 344 in the open position.

As shown, the packer assembly 380 engages the collar 350A due to the packer assembly's engagement with the casing string 310 and the axial movement of the tool body 340. As the packer assembly 380 engages the casing string 310, the packer assembly 380 resists axial movement and slides on the tool body 340 between the collars 350A and 350B as the tool body 340 is displaced. Thus, the packer assembly 380 can remain stationary relative to the tool body 340 as the tool body 340 is moved in a downward direction (e.g., along the y-axis 391), while maintaining the fluid barrier between the upper and lower annuluses 324, 334.

As fluid is delivered to the bottom of the wellbore (e.g., the well bottom 126 of FIG. 2) through the liner (e.g., the liner 132 of FIG. 2), the fluid returns to the surface through the lower annulus 334. However, with the packer assembly 380 set, a fluid barrier remains between the upper annulus 324 and the lower annulus 334. Pressure builds in the lower annulus 334 such that fluid is diverted into the crossover tool 328 (as indicated by arrow K) and delivered into the upper annulus 324 (as indicated by arrow L). Thus, the crossover tool 328 provides a flow path that bypasses the packer assembly 380 to deliver fluid in a conventional circulation flow path.

Figure 21:
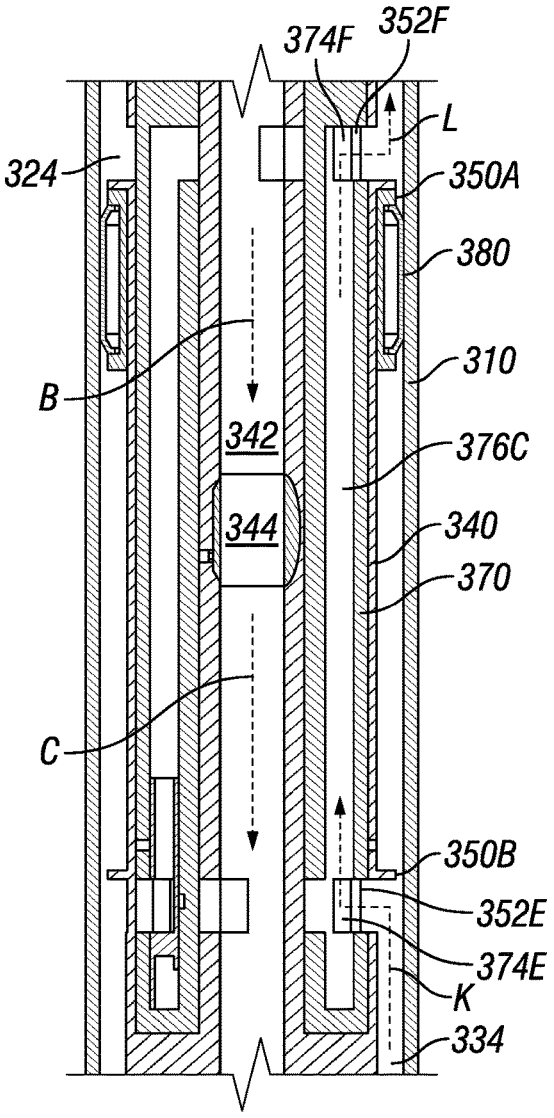

FIG. 21 shows an enlarged cross-section view of the crossover tool 328 set in a conventional circulation mode after switching from a reverse circulation mode as illustrated in FIG. 13, in accordance with one or more embodiments. As shown, the sleeve 370 is in an azimuthal orientation so that the crossover tool 328 is in fluid communication with the lower annulus 334 and the upper annulus 324. As pressure builds in the lower annulus 334 from the fluid barrier created by the packer assembly 380, fluid flows into the channel 376C through ports 352E and 374E. The channel 376C is in fluid communication with the upper annulus 334 via the ports 352F and 374F, and thus, the fluid is directed to the upper annulus 324 through the channel 376C. With the sleeve 370 in this azimuthal orientation shown, the crossover tool 328 delivers the return fluid in a conventional circulation path as indicated by arrows K and L. It should be appreciated that the crossover tool 328 may include additional or alternative channels to switch to a conventional circulation flow path once the packer assembly 380 is set.

As described herein with respect to FIGS. 3-21, it should be appreciated that the crossover tool 328 provides a mechanism to switch between reverse circulation and conventional circulation flow paths once the packer assembly 380 is set. That is, the crossover tool 328 can continue to switch between reverse circulation and conventional flow paths as many times is necessary once the packer assembly 380 is set.

In addition to the embodiments described above, many examples of specific combinations are within the scope of the disclosure, some of which are detailed below:

EXAMPLE 1

A system for controlling fluid circulation in a wellbore intersecting a subterranean earth formation, comprising:

- a tubing string locatable in the wellbore such that an annulus is formed between the tubing string and the wellbore; and
- a crossover tool, comprising:
  - a tool body comprising a bore in fluid communication with the tubing string and a valve located in the bore;
  - a packer assembly coupled to the tool body and configured to create a fluid barrier in the annulus, the barrier dividing the annulus into an upper annulus and a lower annulus;
  - a drag block assembly configured to engage the wellbore and resist axial movement; and
  - a sleeve located in the tool body and axially moveable relative to the drag block assembly, wherein the drag block assembly is coupled to the sleeve, and axial movement of the sleeve relative to the drag block assembly rotates the sleeve to control the valve.

EXAMPLE 2

The system of example 1, wherein the valve includes a pin extended through the body and engaged with a groove in the sleeve so as to rotate when the sleeve rotates relative to the body.

EXAMPLE 3

The system of example 1, wherein the crossover tool further comprises channels configured to provide fluid flow paths to the lower annulus and the upper annulus.

EXAMPLE 4

The system of example 3, wherein the channels comprise:

- a channel configured to divert fluid flow in the bore above the valve, when the valve is closed, into the lower annulus; and
- another channel configured to divert fluid flow in the bore below the valve, when the valve is closed, to the upper annulus.

EXAMPLE 5

The system of example 1, wherein the crossover tool further comprises a piston located between the sleeve and the tool body and comprising a port, wherein when the valve is closed, fluid is flowable through the port to expand the packer assembly and axially move the piston to allow fluid into the lower annulus.

EXAMPLE 6

The system of example 5, wherein the packer assembly includes a rupture disk configured to block a fluid flow to expand the packer assembly until a threshold pressure is reached.

EXAMPLE 7

The system of example 1, wherein the sleeve includes a helical groove configured to receive a portion of the drag block assembly and transfer axial movement of the sleeve relative to the drag block assembly to a rotational movement of the sleeve.

EXAMPLE 8

The system of example 4, wherein the sleeve is located in an annular cavity formed in the tool body.

EXAMPLE 9

The system of example 1, wherein the body is axially moveable relative to the packer assembly.

EXAMPLE 10

The system of example 1, wherein the tubing string comprises a liner, and the crossover tool is configured to allow reverse cementing of the liner in the lower annulus.

EXAMPLE 11

A method of controlling fluid circulation in a wellbore intersecting a subterranean earth formation, wherein a tubing string is located in the wellbore and comprises a bore such that an annulus is formed between the tubing string and the wellbore, comprising:

delivering fluid through the tubing string bore;

resisting axial movement of a body in a first direction on the tubing string relative to a drag block assembly to rotate a sleeve housed in the body in a second direction, wherein the rotational movement of the sleeve in the second direction closes a valve in the bore and diverts the fluid above the valve into a channel in fluid communication with a packer assembly;

expanding the packer assembly with the diverted fluid to create a fluid barrier in the annulus, the barrier dividing the annulus into an upper annulus and a lower annulus;

moving a piston with the diverted fluid to allow the fluid above the valve to flow from the bore to the lower annulus;

returning the diverted fluid from the lower annulus into the tubing string bore; and diverting the fluid in the bore below the closed valve to the upper annulus.

EXAMPLE 12

The method of example 11, further comprising:

resisting axial movement of the body in a second direction to rotate the sleeve in a fourth direction opposite the second, wherein the rotational movement of the sleeve in the fourth direction opens the valve in the bore;

delivering the fluid into the annulus lower through a distal end of the bore; and bypassing the fluid in the lower annulus around the packer assembly to the upper annulus to circulate the fluid in a conventional circulation mode.

EXAMPLE 13

The method of example 12, further comprising:

resisting axial movement of the body in the first direction to rotate the sleeve in the second direction relative to the body, wherein the rotational movement of the sleeve in the second direction closes the valve in the bore; and diverting the fluid above the closed valve in the bore to the lower annulus to circulate the fluid in a reverse circulation mode.

EXAMPLE 14

The method of example 11, wherein expanding the packer assembly comprises rupturing a rupture disk at a threshold pressure to allow the diverted fluid to expand the packer assembly.

EXAMPLE 15

The method of example 11, wherein the fluid includes at least one of a cementing fluid, a drilling fluid, a completion fluid, and a treatment fluid.

EXAMPLE 16

The method of example 11, further comprising cementing a portion of the tubing string in the wellbore with the diverted fluid in the annulus.

EXAMPLE 18

A crossover tool for controlling fluid circulation in a wellbore intersecting a subterranean earth formation, comprising:

a tool body locatable in the wellbore comprising:

a bore; and a valve located in the bore;

a packer assembly coupled to the tool body and configured to create a fluid barrier in the wellbore, the barrier dividing the wellbore into an upper annulus and a lower annulus;

a drag block assembly configured to engage the wellbore and resist axial movement; and a sleeve located in the tool body and axially moveable relative to the drag block assembly, wherein the drag block assembly is coupled to the sleeve, and axial movement of the sleeve relative to the drag block assembly rotates the sleeve to control the valve.

EXAMPLE 19

The crossover tool of example 18, wherein the valve includes a pin extended through the body and engaged with a groove in the sleeve so as to rotate when the sleeve rotates relative to the body.

EXAMPLE 20

The crossover tool of example 19, wherein the crossover tool further comprises:

a channel configured to divert fluid flow in the bore above the valve, when the valve is closed, into the lower annulus; and another channel configured to divert fluid flow in the bore below the valve, when the valve is closed, to the upper annulus.

This discussion is directed to various embodiments. The drawing figures are not necessarily to scale. Certain features of the embodiments may be shown exaggerated in scale or in somewhat schematic form and some details of conventional elements may not be shown in the interest of clarity and conciseness. Although one or more of these embodiments may be preferred, the embodiments disclosed should not be interpreted, or otherwise used, as limiting the scope of the disclosure, including the claims. It is to be fully recognized that the different teachings of the embodiments discussed may be employed separately or in any suitable combination to produce desired results. In addition, one skilled in the art will understand that the description has broad application, and the discussion of any embodiment is meant only to be exemplary of that embodiment, and not intended to suggest that the scope of the disclosure, including the claims, is limited to that embodiment.

Certain terms are used throughout the description and claims to refer to particular features or components. As one skilled in the art will appreciate, different persons may refer to the same feature or component by different names. This document does not intend to distinguish between components or features that differ in name but not function, unless specifically stated. In the discussion and in the claims, the terms "including" and "comprising" are used in an open-ended fashion, and thus should be interpreted to mean "including, but not limited to . . . ." Also, the term "couple" or "couples" is intended to mean either an indirect or direct connection. In addition, the terms "axial" and "axially" generally mean along or parallel to a central axis (e.g., central axis of a body or a port), while the terms "radial" and "radially" generally mean perpendicular to the central axis. The use of "top," "bottom," "above," "below," and variations of these terms is made for convenience, but does not require any particular orientation of the components.

Reference throughout this specification to "one embodiment," "an embodiment," or similar language means that a particular feature, structure, or characteristic described in connection with the embodiment may be included in at least one embodiment of the present disclosure. Thus, appearances of the phrases "in one embodiment," "in an embodiment," and similar language throughout this specification may, but do not necessarily, all refer to the same embodiment.

Although the present disclosure has been described with respect to specific details, it is not intended that such details should be regarded as limitations on the scope of the disclosure, except to the extent that they are included in the accompanying claims.

What is claimed is:

1. A system for controlling fluid circulation in a wellbore intersecting a subterranean earth formation, comprising:

a tubing string locatable in the wellbore such that an annulus is formed between the tubing string and the wellbore; and a crossover tool, comprising:

a tool body comprising a bore in fluid communication with the tubing string and a valve located in the bore;

a packer assembly coupled to the tool body and configured to create a fluid barrier in the annulus, the barrier dividing the annulus into an upper annulus and a lower annulus;

a drag block assembly configured to engage the wellbore and resist axial movement; and a sleeve located in the tool body and axially moveable relative to the drag block assembly, wherein the drag block assembly is coupled to the sleeve, and axial movement of the sleeve relative to the drag block assembly rotates the sleeve to control the valve between an open position and a closed position;

a liner in fluid communication with and positioned downhole of the crossover tool;

wherein the crossover tool is configured to receive fluid from the surface through the tubing string and return the fluid to the surface through the upper annulus; and wherein the open position allows the fluid to enter the liner and return to the crossover tool through the lower annulus, and the closed position allows the fluid to enter the lower annulus and return to the crossover tool through the liner.

2. The system of claim 1, wherein the valve includes a pin extended through the body and engaged with a groove in the sleeve so as to rotate when the sleeve rotates relative to the body.

3. The system of claim 1, wherein the crossover tool further comprises channels configured to provide fluid flow paths to the lower annulus and the upper annulus.

4. The system of claim 3, wherein the channels comprise:

a channel configured to divert fluid flow in the bore above the valve, when the valve is closed, into the lower annulus; and another channel configured to divert fluid flow in the bore below the valve, when the valve is closed, to the upper annulus.

5. The system of claim 1, wherein the crossover tool further comprises a piston located between the sleeve and the tool body and comprising a port, wherein when the valve is closed, fluid is flowable through the port to expand the packer assembly and axially move the piston to allow fluid into the lower annulus.

6. The system of claim 5, wherein the packer assembly includes a rupture disk configured to block a fluid flow to expand the packer assembly until a threshold pressure is reached.

7. The system of claim 1, wherein the sleeve includes a helical groove configured to receive a portion of the drag block assembly and transfer axial movement of the sleeve relative to the drag block assembly to a rotational movement of the sleeve.

8. The system of claim 7, wherein the sleeve is located in an annular cavity formed in the tool body.

9. The system of claim 1, wherein the body is axially moveable relative to the packer assembly.

10. The system of claim 1, wherein the tubing string comprises a liner, and the crossover tool is configured to allow reverse cementing of the liner in the lower annulus.

11. A method of controlling fluid circulation in a wellbore intersecting a subterranean earth formation, wherein a tubing string is located in the wellbore and comprises a bore such that an annulus is formed between the tubing string and the wellbore, comprising:

delivering fluid through the tubing string bore;

resisting axial movement of a body in a first direction on the tubing string relative to a drag block assembly to rotate a sleeve housed in the body in a second direction, wherein the rotational movement of the sleeve in the second direction closes a valve in the bore and diverts the fluid above the valve into a channel in fluid communication with a packer assembly;

expanding the packer assembly with the diverted fluid to create a fluid barrier in the annulus, the barrier dividing the annulus into an upper annulus and a lower annulus;

moving a piston with the diverted fluid to allow the fluid above the valve to flow from the bore to the lower annulus;

returning the diverted fluid from the lower annulus into the tubing string bore;

diverting the fluid in the bore below the closed valve to the upper annulus;

resisting axial movement of the body in a second direction to rotate the sleeve in a fourth direction opposite the second, wherein the rotational movement of the sleeve in the fourth direction opens the valve in the bore;

delivering the fluid into the lower annulus through a downhole end of the tubing string bore; and bypassing the fluid in the lower annulus around the packer assembly to the upper annulus to circulate the fluid in a conventional circulation mode.

12. The method of claim 11, further comprising:

resisting axial movement of the body in the first direction to rotate the sleeve in the second direction relative to the body, wherein the rotational movement of the sleeve in the second direction closes the valve in the bore; and diverting the fluid above the closed valve in the bore to the lower annulus to circulate the fluid in a reverse circulation mode.

13. The method of claim 11, wherein expanding the packer assembly comprises rupturing a rupture disk at a threshold pressure to allow the diverted fluid to expand the packer assembly.

14. The method of claim 11, wherein the fluid includes at least one of a cementing fluid, a drilling fluid, a completion fluid, and a treatment fluid.

15. The method of claim 11, further comprising cementing a portion of the tubing string in the wellbore with the diverted fluid in the annulus.

16. A crossover tool for controlling fluid circulation in a wellbore intersecting a subterranean earth formation, comprising:

a tool body locatable in the wellbore comprising:

a bore; and a valve located in the bore;

a packer assembly coupled to the tool body and configured to create a fluid barrier in the wellbore, the barrier dividing the wellbore into an upper annulus formed between the wellbore and a tubing string positioned uphole of the crossover tool and a lower annulus formed between the wellbore and a liner positioned downhole of the crossover tool;

a drag block assembly configured to engage the wellbore and resist axial movement; and a sleeve located in the tool body and axially moveable relative to the drag block assembly, wherein the drag block assembly is coupled to the sleeve, and axial movement of the sleeve relative to the drag block assembly rotates the sleeve to control the valve between an open position and a closed position;

wherein the crossover tool is configured to receive fluid from the surface through the and return the fluid to the surface through an upper annulus; and wherein the open position allows the fluid to enter the liner and return to the crossover tool through a lower annulus, and the closed position allows the fluid to enter the lower annulus and return to the crossover tool through the liner.

17. The crossover tool of claim 16, wherein the valve includes a pin extended through the body and engaged with a groove in the sleeve so as to rotate when the sleeve rotates relative to the body.

18. The crossover tool of claim 17, wherein the crossover tool further comprises:

a channel configured to divert fluid flow in the bore above the valve, when the valve is closed, into the lower annulus; and another channel configured to divert fluid flow in the bore below the valve, when the valve is closed, to the upper annulus.

* * * * *